United States Patent [19]

Korsvik

[11] 4,271,553

[45] Jun. 9, 1981

[54] SYSTEM FOR LAUNCHING AND HAULING IN OBJECTS FROM THE SEA

[75] Inventor: Nils Korsvik, Aukra, Norway

[73] Assignees: A/S Aukra Bruk, Aukra; A/S Blehr Og Tenvig, Oslo, both of Norway

[21] Appl. No.: 334

[22] Filed: Jan. 2, 1979

[30] Foreign Application Priority Data

Jan. 6, 1978 [NO] Norway ..... 780060

[51] Int. Cl.[3] ..... B63C 9/22; B63B 23/30

[52] U.S. Cl. ..... 9/14; 9/30; 9/39; 9/42

[58] Field of Search ..... 9/30, 31, 34, 35, 36, 9/39, 42, 14, 32, 33, 37, 38, 1.2; 414/137, 138, 140; 114/259, 44, 45

[56] References Cited

U.S. PATENT DOCUMENTS

| | | | |
|---|---|---|---|
| 1,116,761 | 11/1914 | Thompson | 9/42 X |
| 1,275,399 | 8/1918 | Crooks | 9/42 |
| 2,206,160 | 7/1940 | Carroll | 9/14 |
| 2,361,951 | 11/1944 | Livermon | 9/1.2 |
| 3,092,856 | 6/1963 | Wallace et al. | 9/39 |
| 3,150,389 | 9/1964 | Woodworth | 9/30 |
| 3,421,165 | 1/1969 | Pugh | 9/14 |

*Primary Examiner*—Sherman D. Basinger

[57] ABSTRACT

A method and apparatus for launching and hauling in objects such as life-boats, pick-up boats, small submarines and people from the sea, which includes a floating dock suspended from a yoke connected to a jib attached to a floating vessel, the yoke being capable of substantially following the swell movements of the sea. A substantially constant spacing is maintained between the floating dock and the vessel while the dock is floating in the sea.

11 Claims, 9 Drawing Figures

28'
28'
30
30
32
29
29
25
28
28

32
25
25

SYSTEM FOR LAUNCHING AND HAULING IN OBJECTS FROM THE SEA

BACKGROUND OF THE INVENTION

The present invention relates to a method and apparatus for launching and hauling in objects such as life-boats, pick-up boats, small submarines and the like, as well as for rescuing people and other loose objects.

The invention is particularly suitable for putting a life-boat or the like into a body of water, or taking it out of the water, even during rough weather conditions, without risking damage to the life-boat in the process. The invention is particularly useful for rescue operations where a life-boat must be launched for picking up people from the sea in rough weather. The invention also makes it possible to rescue people, for instance the victims of a shipwreck lying in the sea, as well as loose objects.

Usually life-boats are suspended in various types of davits, and large life-boats are normally arranged in fall-davits which by means of hooks are fastened in blocks or winches for lowering the boat. In bad weather, when rough seas are predominant and accidents occur, it becomes both dangerous and precarious to launch a boat at sea. The boat normally hangs from two hooks which must be undone quickly and safely under rough sea conditions. A wave hitting against the side of a ship will often build up and create big vertical forces by rising far higher than it would otherwise do. A boat lying close to the ship's side will therefore be exposed to bigger movements than the boat lying at some distance from the ship. It can be therefore seen that the sea need not be particularly rough before it becomes difficult or perhaps quite impossible to haul in a life-boat.

By means of the present invention it is possible to launch in the sea and pick up objects, for example life-boats, from much rougher waters than has been considered heretofore possible.

An understanding of the invention will be had from a reading of the following description taken with reference to the accompanying drawings.

DETAILED DESCRIPTION OF THE PREFERRED EMBODIMENTS

Figure 1:
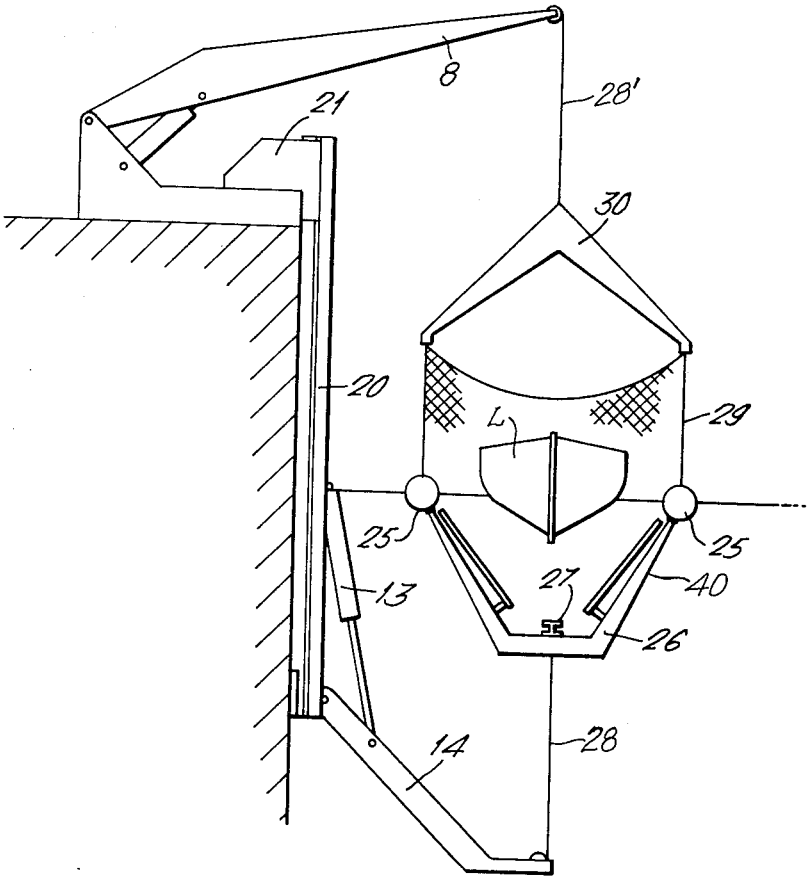
FIG. 1 shows the launching and hauling in structure according to the invention in a lowered condition.
Figure 5:
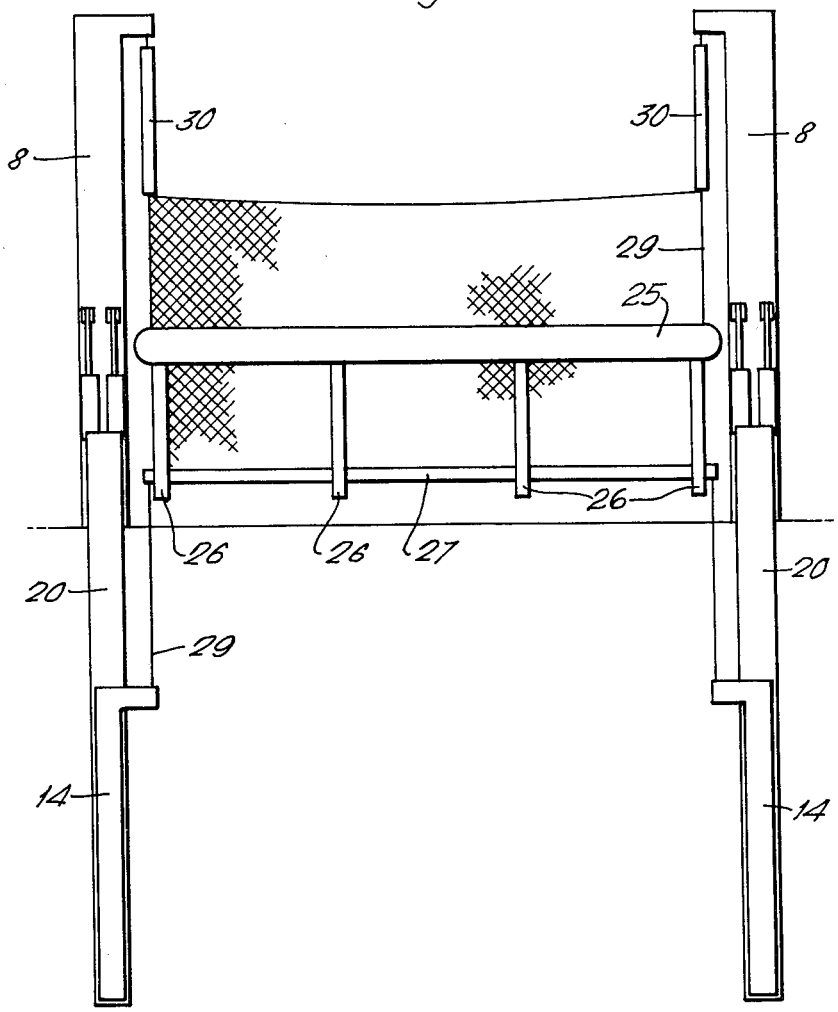
FIG. 5 illustrates the structure of FIG. 3 seen from the side.

The invention is based on the use of a floating structure such as a cage, basket or dock floating structure, which is suspended from one or two jibs by means of one or two yokes, and which has one or two wires connected between the lower side of the floating structure and one or two beams located below the water's surface, such that the floating structure will be held tight between two or four wires. According to the invention, the structure should float in the water, i.e., the sea, under full control, and should have an opening at one end where, e.g. a life-boat can be guided in. In the preferred design as shown in FIG. 1, the floating structure is in the form of a floating dock 40 which is suspended from an upper yoke 30 which, in turn, is connected via a wire 28' to a jib 8. The dock 40 includes two longitudinal cylindrical floats 25 which are attached to the ends of multiple spaced apart ribs 26 (see FIGS. 1 and 5).

To make sure that the dock 40 will lie calmly in the sea, the dock is connected by wire 28 to a lower beam 14 situated below the surface of the sea, and beam 14 is provided with a slide 20 and a cylinder 13. Beam 14 also ensures that the dock does not move horizontally relative to ships on which jib 8 is mounted. The distance from the upper and lower fastening points of the dock to the upper and lower beams, respectively, is determined by the size of the movement which may occur between ship and dock in the sea. To prevent the dock from rolling horizontally, the upper and lower wires 28' and 28 must be tight in opposing directions. This is made possible by means of a movement compensator system consisting of gig winches which are hydraulically coupled.

Figure 2:
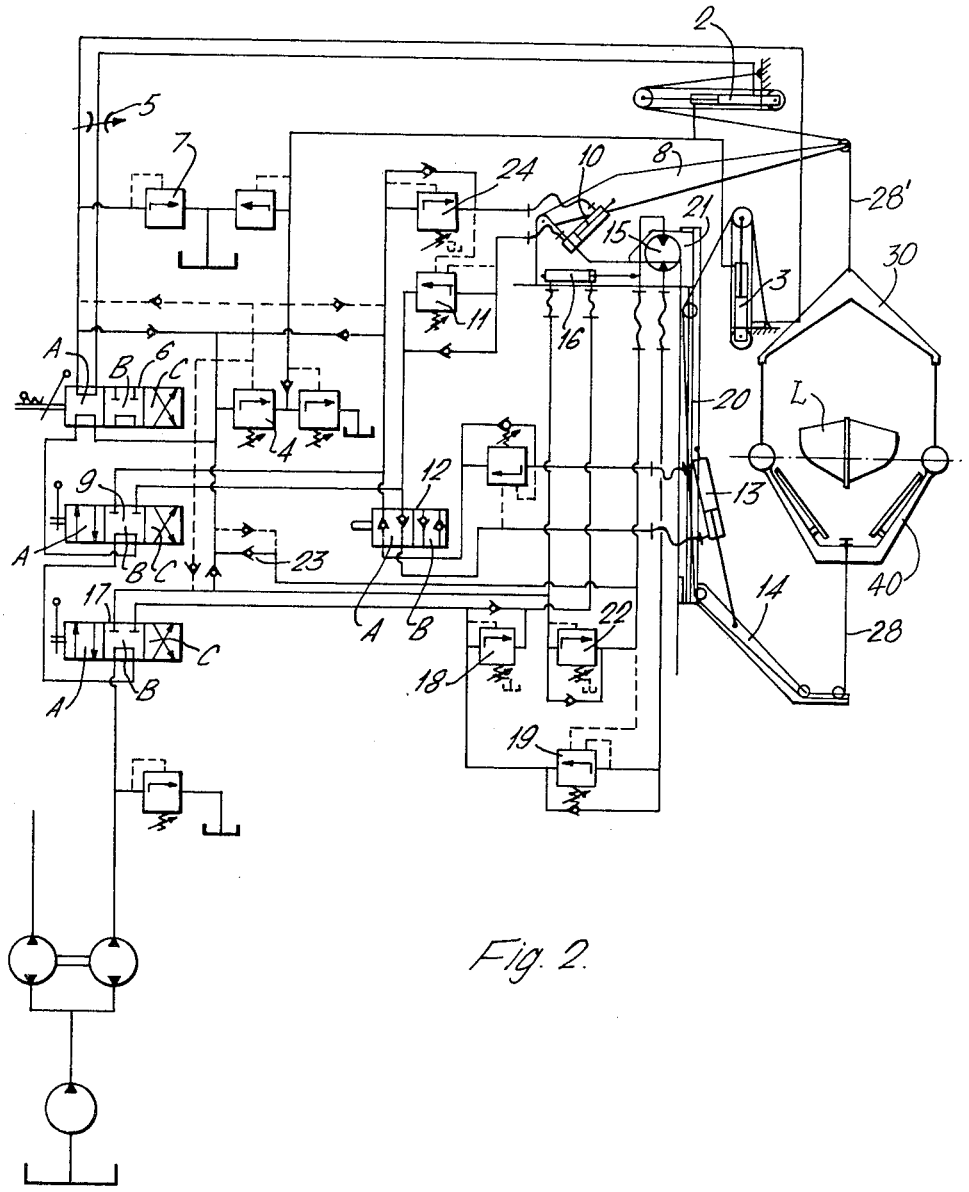
FIG. 2 illustrates a hydraulic system for controlling the launching and hauling in structure according to the invention.

The two hydraulic cylinders or gig winches 2 and 3 in FIG. 2 are subjected to a static pressure. The tractive power from the gig winches works in the opposite direction, and a pull will be obtained in relation to the pressure given which can be adjusted by means of pressure valve 4. On the vertical plane the dock will then move together with the surface of the sea, as the dock has positive buoyancy due to floats 25 (see FIG. 1). A throttle valve 5 (FIG. 2) is provided to dampen the movements over and above the restriction created by the wire friction and the resistance in the hydraulic pipe. A life-boat L, which is to be taken on board the ship, is brought into the dock, usually unaided. The boat and dock will have the same movements, inasmuch as they both float in the sea, so that the vertical movement is approximately the same. When the dock is hauled in, control valve 6 and gig winch 2 are used. By increasing the pressure in winch 2, a pulling of the wire will result. Gig winch 3 will also tighten the wire with the aforementioned tractive power which is exerted by the back pressure from pressure valve 4. A controlled hauling-in of the dock will thus be obtained at the same time as the tension from the lower pair of wires 28 will keep the dock so tightly suspended that it is prevented from excessive movements on the horizontal plane when the ship is rolling.

Figure 3:
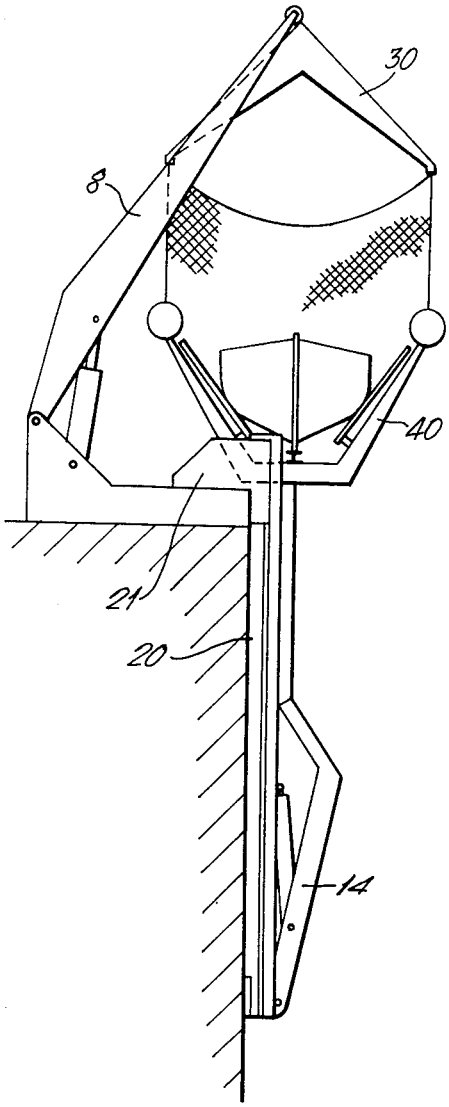
FIG. 3 shows the structure of FIG. 1 when in a hauling-in position.
Figure 4:
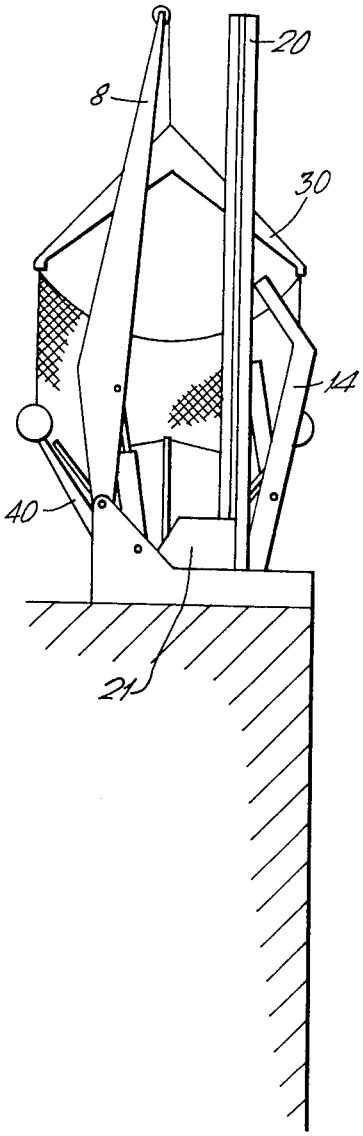
FIG. 4 shows the structure of FIG. 1 when in a rest position on board a ship.

Excessive amounts of hydraulic fluid from gig winch 3 will pass out through a safety valve 7. The dock is lifted up so high that it hits against jib 8. This will correspond to the height required for picking up the dock from the tallest waves. To haul the dock further, a control valve 9 is used which guides hydraulic fluid to a cylinder 10 through the back-pressure valve of an overcenter valve 11. The hydraulic fluid is also led to a change-over valve 12, but is blocked by the back-pressure valve in it. Cylinder 10 will raise jib 8 to the position, shown in FIG. 3. When the jib reaches this position, a cam will change the situation in change-over valve 12, and the hydraulic fluid will go to cylinder 13 lifting beam 14 as shown in FIG. 3. FIG. 3 illustrates the position of the arrangement according to the invention when it is "ready for use". FIG. 4 shows the arrangement in a rest position. This position is obtained by using control valve 9 to carry even more fluid to cylinder 10 so as to effect the position of jib 8 as is shown in FIG. 4.

Furthermore, it must also be possible to bring the equipment holding beam 14 in place on board the vessel, and this is done by means of a motor 15 and a cylinder 16 which are controlled by a control valve 17. When the control valve, section C, is in, the following will occur: The hydraulic fluid is led to sequence valve 18 and overcenter valve 19. Sequence valve 18 will block the flow of hydraulic fluid as long as the adjusted pressure is not exceeded. Back-pressure valve of overcenter valve 19 lets the hydraulic fluid through and it passes on to motor 15. This will lift up, via suitable means (not shown), slide 20 to its end position. Carriage 21 will guide this motion. More hydraulic fluid is added, and the pressure will exceed the set pressure of the sequence valve, and this will let hydraulic fluid pass through to cylinder 16 which will move carriage 21 inwardly of the ship's side via suitable means (not shown). All the equipment in the "at rest" position is shown in FIG. 4.

The following operation is carried out for placing the equipment back into the position of FIG. 3: Control valve 17 is put in position A and will then bring oil to cylinder 16 and sequence valve 22. The sequence valve does not open until the set pressure is reached. The cylinder will thereby receive hydraulic fluid and move carriage 21 to its end position, so that slide 20 projects over the side of the ship. When an additional amount of hydraulic fluid is added, the sequence valve opens and conveys fluid to motor 15. Overcenter valve 19 will retain the return fluid from motor 15, so that the slide can move out under full control. The overcenter valve only opens for pressure from the control valve, and if the motor tries to run off, the inlet pressure will diminish and overcenter valve 19 will close. When the slide has been taken all the way out, it can be locked in its end position by means of a device on the ship's side. In addition there will be a static oil pressure through back-pressure valve 23. Valve 17 is put in position B.

Control valve 6, which is normally set in position B by parking, is put in position C, and the dock is lifted up under the top of jib 8. The valve is subsequently set in position B, and the dock is suspended from the jib.

Control valve 9 is put in position A and the jib is lowered to the position shown in FIG. 3. The hyraulic fluid will then move towards change-over valve 12, which in the parked position will be in position B, and will not pass through this, but will move towards sequence valve 24 until the pressure overcomes the set pressure of it and is brought to the top of cylinder 10 which will lower jib 8. The brake valve for the lowering operation or overcenter valve 11 brakes the hyraulic fluid from the opposite side of the cylinder, so that the lowering operation is kept under control by the fluid added on top of the cylinder. Control valve 9 is put back in position B, and the equipment is ready for use, as illustrated in FIG. 3.

During the entire operation the static pressure exerted by pressure valve 4 is in operation and will keep the wire taut from the lower side of the dock by means of gig winch 3. Thus, the life-boat may be boarded and unboarded in this position.

When dock 40 and life-boat L are launched in the sea, the following occurs: Control valve 9 is put in position A and the fluid will flow to change-over valve 12. This is still in position B and will block the hydraulic fluid's passage in the following manner. The fluid also moves towards sequence valve 24, and overcoming the set pressure it will act on cylinder 10 which will lower jib 8. A mechanical device on jib 8 will immediately push change-over valve 12 to position A. Hydraulic fluid is thereby let through to the top of cylinder 13. As the fluid pressure must be greater to release sequence valve 24 than is required for laying out beam 14 by means of cylinder 13, jib 8 will stop until beam 14 has reached its end position. The pressure will now rise above the sequence setting range, and jib 8 may be put out. Beam 14 is prevented from moving out faster than the quantity let in on account of the pull in the wire from gig winch 3. When beam 14 has reached its end position, jib 8 starts moving towards its end position. When this has been reached, control valve 9 is put back in position B. Control valve 6 is put in position A and gig winch 2 is released, whereupon the dock is launched in the sea. The dock will float sufficiently deep so that the life-boat will be able to float into it, and—as can be seen—the life-boat can move out directly, i.e., forward or backward, depending on the opening of the net 32.

The dock 26 is seen to also include, interconnected by means of ribs 26 a longitudinal beam 27 mounted between the ribs 26 which also serves as a support for the life-boat, which life-boat rests against it when parked and when in "ready for use" position, as shown in FIG. 3. The centre ribs 26 also have pads 31 (FIG. 9) fitted for supporting the boat. These may be spring-cushioned to suit various boat sizes.

Further, the dock 40 is suspended in wires 29 and yoke 30. At the sides, between the wires in which the dock is suspended, a netting 32 is provided which preferably should have a coarse mesh made of ropes or wire. Preferably, there should also be netting under the floats and ribs. This can best be seen in FIGS. 7–9. As illustrated in the drawings, netting has been arranged so that it can be opened and closed in order that the life-boat, for example, may enter from one side and move against the other side which is closed to prevent the boat from moving away from the dock. When the boat is launched from the dock, the end through which the boat entered may be closed and the other opened, so that the boat may leave the dock in the same direction it entered. However, the dock may be open at both ends, if desired.

Figure 9:
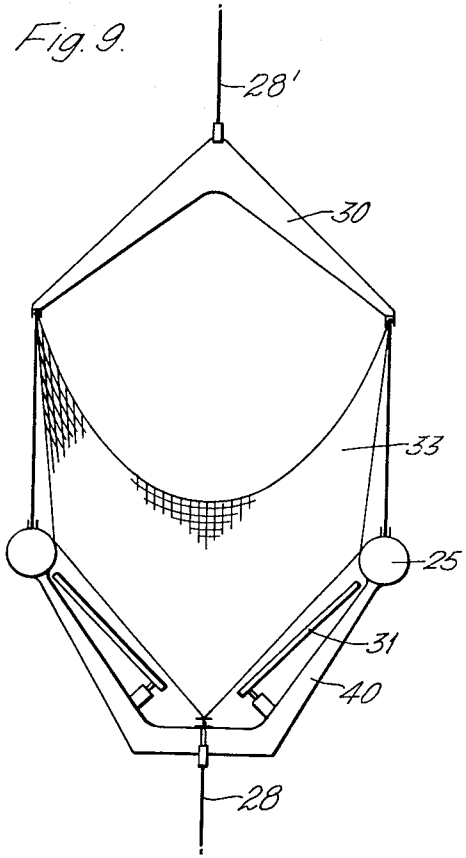
FIGS. 7, 8 and 9 illustrate part of the structure of FIGS. 1–6, viz., the pick-up dock provided with netting and sketched from the side, top and end, respectively.
Figure 7:
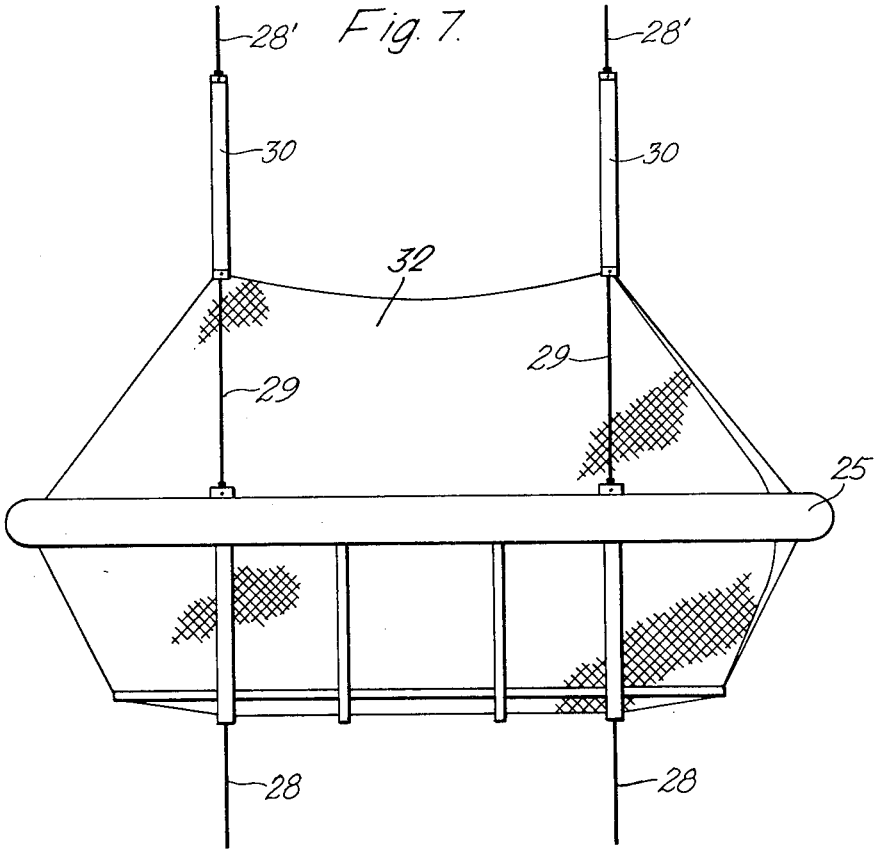
Figure 8:
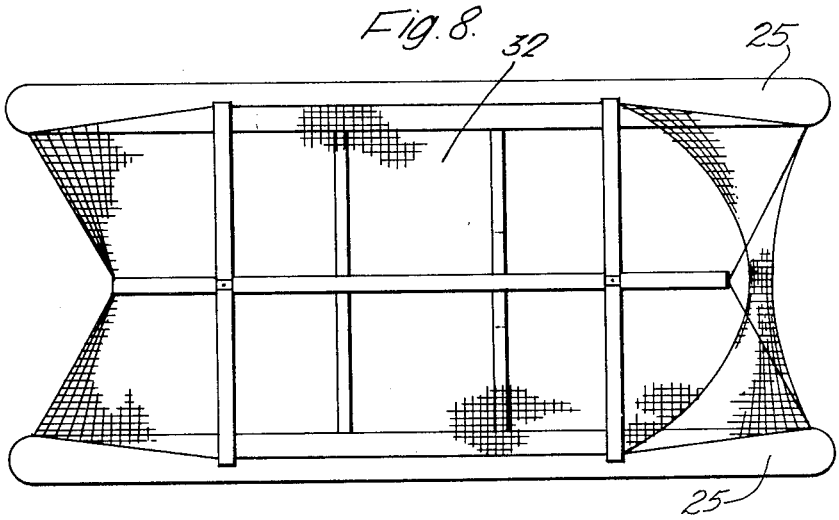

As can be seen in FIGS. 7–9, net 32 may also be used to pick up people who are swimming or floating in the water, and for this purpose it may be expedient to have an inlet funnel, for instance in the shape of floats arranged at increasingly greater distances from the ship's side, so that those who are to be picked up in the dock are not hit by floats 25 or pass between the ship's side and the inner float 25.

As an alternative to beam 14 there may be other pull compensators, such as sluggishness arrangements placed under the dock which to a certain extent would counteract movements of the dock which are not in accordance with the movements of the ship and the waves.

The invention will also be suitable for picking up floating objects from the sea.

Figure 6:
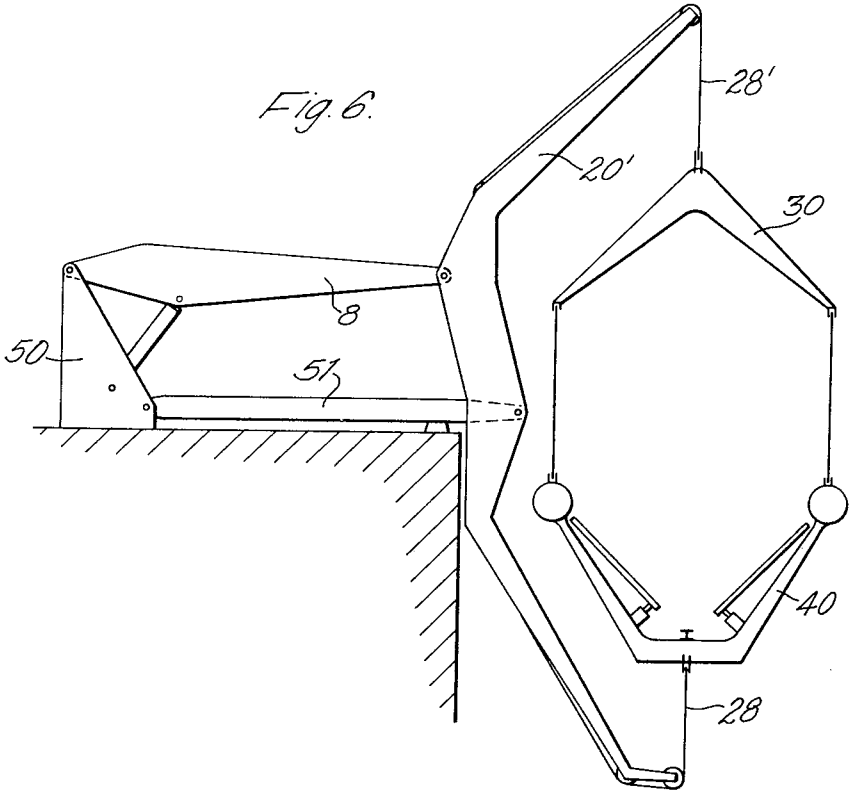
FIG. 6 depicts a modified version of the structure shown in FIGS. 1, 3, 4 and 5.

In other embodiments of the invention the slide system 20 can be replaced with a system where beam 14 and jib 8 are integral or perhaps hinged together, as shown at 20' in FIG. 6.

In this regard, FIG. 6 shows an embodiment of the invention wherein a generally C-shaped support member 20' is supported in position beyond the side of a ship or stationary installation (for picking up objects) by a jib 8 and a pivot bar 51, both the jib 8 and the pivot bar 51 being pivotally connected between the C-shaped support member 20' and a mount 50 which is located on the top of the ship or stationary installation. The pivot bar 51 is pivotally connected to the C-shaped support member 20' at a point below where the jib 8 is connected thereto and to the mount 50 at a point below where the jib 8 is connected. The jib 8 is sufficiently long to extend from the mount 50 to a point near to the side of the ship or stationary installation. A yoke 30 is suspended by a wire 28' from the upper free end of the generally C-shaped support member 20' and a floatable dock 40 is suspended from the yoke 30. A wire 28 is connected between the bottom of the floatable dock 40 and the lower free end of the generally C-shaped support member 20'. Suitable rotation of the jib 8 and the pivot bar 51 around the pivots attached to mount 50 will cause the yoke 30 and the floatable dock 40 to be repositioned to a point above the top of the ship or stationary installation.

The arrangement as shown in FIG. 6 may be particularly suitable on board ships or drilling rigs or other locations where there is adequate space.

It is obvious that the invention is also suitable for use in connection with, for example, stationary drilling rigs at sea or in places where it may be practically impossible to pick up or launch life-boats because of rough seas.

Within the framework of the invention it would be possible to provide the dock with joints, so that it can be collapsed for occupying less room on board.

By the preferred design, arms 8 and possibly 14 are made telescopic, so that the distance between the dock and the ship's side may be adjusted. The invention can be applied on vessels which are on the move as well as on vessels at anchor.

In the case of tall ships it will be more appropriate to replace the lower arm 14 with a sluggishness device, often called a log chip.

I claim:

1. An apparatus for launching and hauling in objects such as boats and people from the sea, said apparatus including:

a pivotable jib means which is mountable on the top of a floating vessel or stationary platform so as to be capable of having its free end extend beyond the side of said floating vessel or stationary platform, a stabilizing means positionable along the side of said floating vessel or stationary platform so as to be locatable below the free end of said pivotable jib means when said free end extends beyond the side of said floating vessel or stationary platform, a yoke means suspended from the free end of said jib means, an elongated floatable dock means suspended from said yoke means, said floatable dock means comprising a dock body and multiple floats mounted thereon so as to buoy said dock body in the water, an adjustable pick-up net mounted between said yoke means and said floatable dock means, and means connecting said floatable dock means with said stabilizing means so as to stabilize the movement of said dock means and maintain a substantially constant spacing between said dock means and the side of said floating vessel or stationary platform when said jib means is pivoted so as to move said dock means from a rest position on top of said floating vessel or stationary platform to a floating position in the sea and vice versa.

2. The apparatus as defined in claim 1 wherein said stabilizing means comprises a vertically movable slide member and a beam member which is attached at one end to be pivotable with respect to a lower end of said slide member and which has its opposite end extendable below sea level and at a constant distance away from the side of the floating vessel or stationary platform.

3. The apparatus as defined in claim 2 wherein said means connecting said floating dock means to said stabilizing means comprises at least one wire attached between the bottom of said floating dock means and said opposite end of said beam member.

4. The apparatus as defined in claim 2 including means for vertically moving said stabilizing means along the side of said floating vessel or stationary platform.

5. The apparatus as defined in claim 1 wherein said yoke means is suspended from said jib means by at least one wire.

6. The apparatus as defined in claim 1 wherein means are provided to allow the ends of said adjustable pick-up net to open and close at opposite ends of said floating dock means.

7. The apparatus as defined in claim 1 wherein said dock body comprises multiple, spaced-apart rib means, and wherein support pads are located on one or more of said rib means for contact with the objects to be placed therein.

8. The apparatus as defined in claim 1 wherein means are connected to said pivotable jib means to move same such that said yoke and floating dock means can be elevated and repositioned to be located above the top of said floating vessel or stationary platform.

9. The apparatus as defined in claim 8 wherein said means to move said pivotable jib means includes hydraulic piston and cylinder units.

10. A method for launching and hauling in objects such as boats and people from the sea which comprises placing a pivotable jib means on the top of a floating vessel or stationary platform so as to be capable of having its free end extend beyond the side of said floating vessel or stationary platform, placing a stabilizing means along the side of said floating vessel or stationary platform, suspending a yoke from said jib means, suspending a floatable dock means from said yoke, connecting a taught wire means between said floatable dock means and said stabilizing means so as to stabilize the movement of said dock means and maintain a substantially constant spacing between said dock means and the side of said floating vessel or stationary platform, moving said pivotable jib means and said stabilizing means so as to move said floatable dock means from a rest position on top of said floating vessel or stationary platform to float in the sea, and thereby be capable of supporting objects thereon, and then back to said rest position.

11. An apparatus for launching and hauling in objects such as boats and people from the sea, said apparatus including:

a mounting means which is mountable on the top of a floating vessel or stationary platform, a pivotable jib means mounted on said mounting means so as to have its free end extend to a point near to the side of said floating vessel or stationary platform, a unitary, generally C-shaped support member pivotally attached to the free end of said pivotable jib means, said generally C-shaped support member being positioned beyond the side of said floating vessel or stationary platform, a pivot bar connected between said mounting means and said generally C-shaped support member, said pivot bar being pivotally connected to said generally C-shaped support means at a point below where the free end of said jib means is pivotally connected thereto, a yoke means, a first support wire for suspending said yoke means from the upper free end of said generally C-shaped support means, an elongated floatable dock means suspended from said yoke means, said dock means comprising a dock body and multiple floats mounted thereon so as to buoy said dock body in the water, and a second support wire for connecting the bottom of said floatable dock means to the lower free end of said generally C-shaped support means.

* * * * *